United States Patent [19]

Turner et al.

[11] 4,117,678

[45] Oct. 3, 1978

[54] SELF-CONTAINED HYDRAULIC SWITCH OPERATOR

[75] Inventors: John L. Turner; Fred L. Diener, both of Fairview Heights, Ill.

[73] Assignee: Turner Electric Corporation, East St. Louis, Ill.

[21] Appl. No.: 739,473

[22] Filed: Nov. 8, 1976

[51] Int. Cl.[2] ..... F16D 31/02

[52] U.S. Cl. ..... 60/369; 60/DIG. 2; 307/112; 417/217

[58] Field of Search ..... 60/493, 369, DIG 2; 417/217; 91/443; 307/112

[56] References Cited

U.S. PATENT DOCUMENTS

| | | | |
|---|---|---|---|
| 2,388,755 | 11/1945 | McLeod | 60/406 |
| 2,582,556 | 1/1952 | Morey | 60/469 |
| 2,795,932 | 6/1957 | McLuen | 60/418 |
| 3,070,954 | 1/1963 | Basso | 60/DIG. 2 |
| 3,761,735 | 9/1973 | Turner et al. | 307/112 |
| 3,941,507 | 3/1976 | Niedermeyer | 417/44 X |

FOREIGN PATENT DOCUMENTS

| | | | |
|---|---|---|---|
| 24,337 | 1971 | Japan | 91/443 |

*Primary Examiner*—Carlton R. Croyle
*Assistant Examiner*—Edward Look
*Attorney, Agent, or Firm*—F. Travers Burgess

[57] ABSTRACT

Self-contained simplified power apparatus for operating electric transmission line switches locally or remotely includes a rotary hydraulic actuator arranged for mechanical coupling to the line switch, a battery-powered reversible low voltage motor operating a reversible hydraulic pump, with the opposite ports of the pump connected respectively to the opposite ports of the hydraulic actuator for selectively producing closing and opening movements of the hydraulic actuator responsive directly to reversals in the direction of the motor and pump, means for selectively starting, stopping and reversing the motor either from a remote point or locally, and means for disengaging the operator from the line switch to permit manual operation of the latter. For line switches that require high speed closure, a modified embodiment of the invention provides electrically controlled hydraulic means to this end.

12 Claims, 9 Drawing Figures

SELF-CONTAINED HYDRAULIC SWITCH OPERATOR

BACKGROUND OF THE INVENTION

1. Field of the Invention

The invention relates to power apparatus for operating electric power line switches and consists particularly in a self-contained operator having an electrically controlled hydraulic actuator arranged for local or remote control.

2. The Prior Art

J. J. Mikos U.S. Pat. No. 2,796,478, discloses a switch operating mechanism in which the switch operation may be effected by a reversible hydraulic ram driven by a reversible hydraulic pump operated by a reversible electric motor as disclosed in C. T. McLuen U.S. Pat. No. 2,795,932. The McLuen mechanism incorporates a 115 volt electric motor, powered from an external source, a complex system of valves and an accumulator in the hydraulic system for operating the ram throughout the full opening and closing cycles.

Our U.S. Pat. No. 3,761,735, which issued Sept. 25, 1973, discloses a power line switch operator having an uni-directional electric motor and hydraulic pump, with reversal of the hydraulic actuator being accomplished by electrically controlled reversing valves between the pump and hydraulic actuator. To permit continued operation of the apparatus in the event of electrical failure, the hydraulic system includes an accumulator capable of powering a number of operating cycles in the event of electrical failure.

SUMMARY OF THE INVENTION

Among the objects and advantages of the invention are the following:

The invention provides an electric self-contained hydraulic switch operator which can be utilized in remote locations and automatic switching schemes.

It provides a switch operator of optimum simplicity and economy in first cost, maintenance and operating costs. This objective is achieved by composing the operator of two principal elements — the hydraulic pump and actuator, the pump being driven by a bi-directional motor to produce a directional flow of hydraulic fluid directly to the rotary actuator with speed adjustments accomplished by micrometer dial type flow control valves in each conduit, the electric apparatus being operated by a storage battery contained in the operator enclosure with battery charge maintained by a regulated charger similarly enclosed.

In the interest of reliability, the need for any four-way directional solenoid valves of the type used in prior art constructions is eliminated by the bi-directional pump. The fact that the rotary actuator, of conventional construction, requires only one moving part for converting hydraulic fluid flow directly into rotary movement, eliminates the need for gear trains and/or rack and pinion assemblies found on electric motor operators, and for linkages for converting the linear movements of hydraulic rams, such as those of the Mikos patent referred to above, to rotary movements.

The invention also provides a self-contained high speed electric hydraulic switch operator arranged for two-speed closing, for operating line switches that require fast closing so as to prevent arcing damage to switch parts.

In the high speed embodiment of the switch, the hydraulic pump driven by a bi-directional electric motor delivers hydraulic fluid to a pressure accumulator for a few seconds after energization of the motor to cause the latter to store the hydraulic fluid under high pressure. When predetermined high pressure is reached, a pressure switch closes, causing a start valve to open and thereby allow the hydraulic fluid to flow from the accumulator through a slow-close speed adjustment to the hydraulic actuator which rotates slowly until the line switch is approximately one-half closed, after which a limit switch operated by the hydraulic actuator in accordance with positions of the line switch causes a close-fast valve in the hydraulic conduit to open and thereby permit much faster flow of hydraulic fluid to the actuator, to cause the switch to slam closed and thus prevent arcing damage to the switch parts. Upon closure of the line switch, another limit switch ends the closing operation.

DETAILED DESCRIPTION OF THE INVENTION

Figure 1:
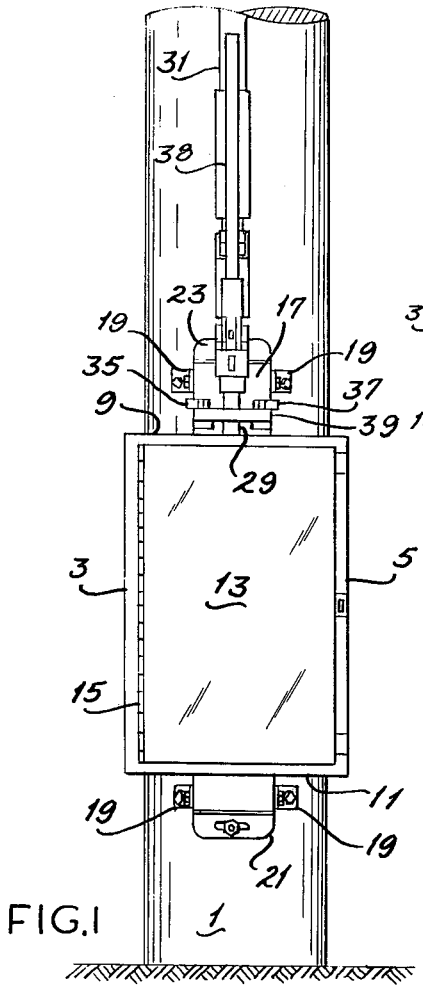
FIG. 1 is a front elevational view of the switch operator embodying the invention showing its mounting on a pole.

The numeral 1 denotes a power line pole mounting a line switch (not shown), at some distance above the ground.

For operating the line switch either locally or by remote control, operating mechanism is provided, comprising a cabinet having side walls 3 and 5, rear wall 7, top wall 9, bottom wall 11, and a front door 13 mounted on side wall 3 by piano hinge 15. An upright channel member 17 is secured by its web to back wall 7 of the cabinet and extends above and below the cabinet and in turn is secured to pole 1 by brackets 19, vertical movement of member 17 on the pole being prevented by horizontal angle brackets 21 and 23 respectively abutting the lower and upper ends of member 17 and secured to pole 1 by through bolts 25.

Figure 3:
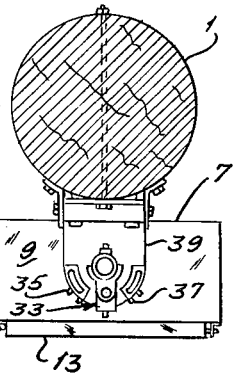
FIG. 3 is a top view of the structure shown in FIGS. 1 and 2.
Figure 2:
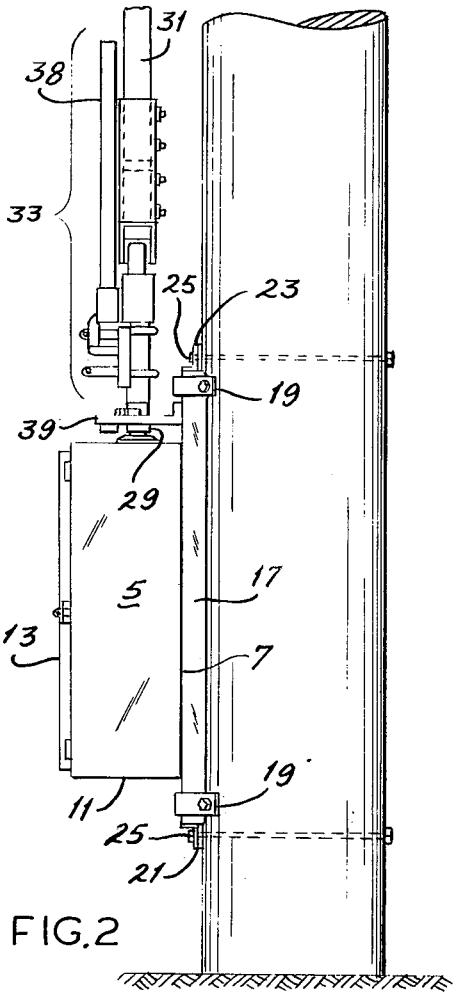
FIG. 2 is a side elevational view of the structure shown in FIG. 1.
Figure 5:
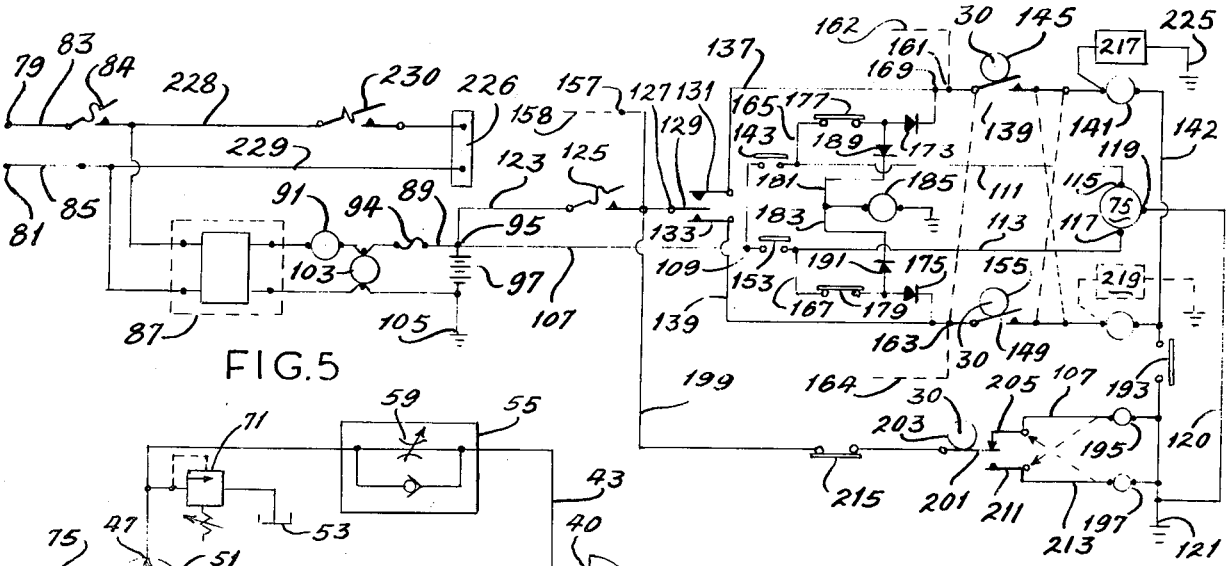
FIG. 5 is an electrical schematic of the operator.
Figure 6:
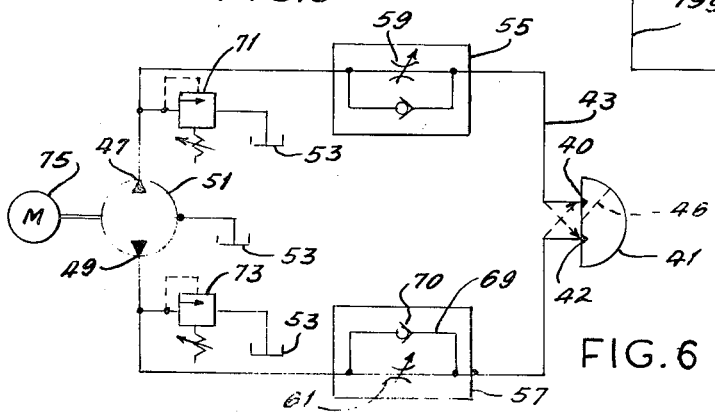
FIG. 6 is a hydraulic schematic of the operator.

The operating mechanism has an output shaft 29 projecting through a suitable aperture in cabinet top wall 9 and connected to upwardly extending operating shaft 31 by a coupling generally indicated at 33, similar to that disclosed at **35*a*–65*a* in FIGS. 3, 5 and 6 of our U.S. Pat. No. 3,761,735. At its upper end (not shown) operating shaft 31 is operatively connected in known manner, e.g., as shown in the aforesaid patent, to the line switch (not shown) which may be of the type denoted by numerals 5*a*–11*c* in our patent. Lock-down stops for manual operation corresponding to stops 61*a***, 63*a* of the patented construction are mounted at 35 and 37 on a shelf-like member 39 projecting outwardly from cabinet-mounting member 17 a short distance above cabinet top wall 9. When manual operating handle 38 is locked in its normal position as shown in FIGS. 1–3 hereof, output shaft 29 will be coupled in torque-transmitting relation to operating shaft 31.

Figure 4:
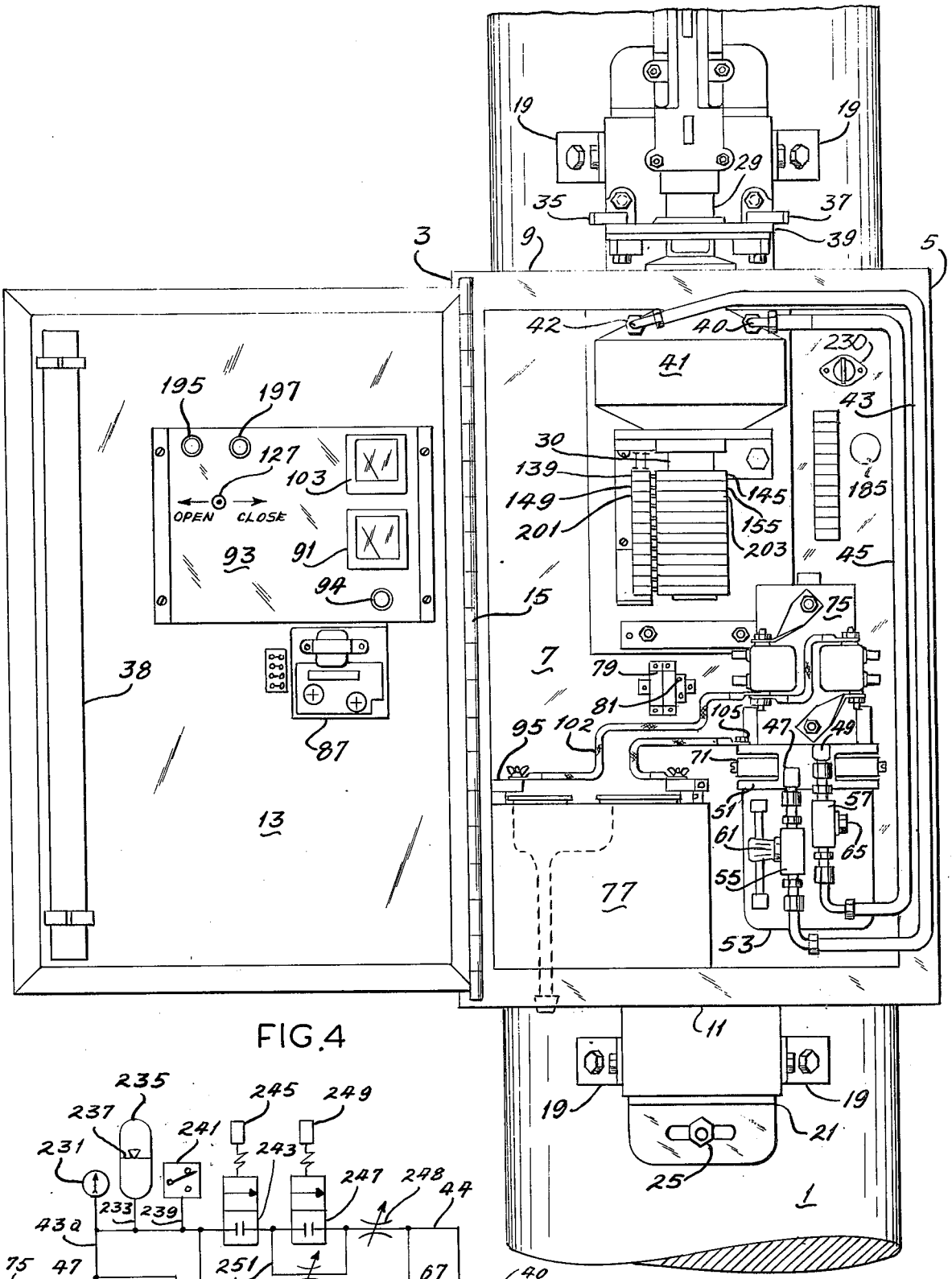
FIG. 4 is a front elevational view of the switch operator with the cabinet door open.

For powering shaft 29, a reversible hydraulic actuator 41 is centrally mounted in the top portion of the cabinet, as best seen in FIG. 4, and has a vane 46 rotatably mounted therein and operatively secured to shaft 29.

For driving shaft 29 in opposite directions between switch-closed and switch-open positions, the opposite ports 40 and 42 of rotary hydraulic actuator 41 are connected respectively, by hydraulic conduits 43 and 45, to the opposite ports 47 and 49 of a reversible hydraulic pump 51 supplied by hydraulic fluid reservoir 53. Hydraulic conduits 43 and 45 respectively contain flow control devices 55 and 57 including manually variable orifice 59 and 61 controlled by knobs 63 and 65, and by-pass conduits 67 and 69 around flow control devices 55 and 57 including one-way check valves 68 and 70 for permitting unobstructed return of hydraulic fluid from the actuator 41 to pump 51. Manually adjustable relief valves are provided between each side of pump 51 and reservoir 53 and are arranged for screwdriver adjustment.

Pump 51 mounts and is driven by a low voltage (e.g. 12 volt) D.C. motor powered by storage battery 77 mounted in the lower left hand corner of the cabinet.

Referring particularly to FIG. 5, power for charging storage battery 77 is provided from a commercial 115 V AC source connected to terminals 79 and 81 in the cabinet, from which conductors 83, including 6 amp fuse switch 84, and 85 lead to battery charger 87, the positive output conductor 89 of which includes an ammeter 91 on a control panel 93 mounted on the inner surface of door 12 and a 2 amp fuse 94, from which conductor 89 leads to the positive terminal 95 of battery 97. Negative output conductor 99 connects the battery charger direct to negative terminal 101 of battery 97, and a voltmeter 103 on control panel 93 is connected across positive and negative output lines 89 and 99. Battery 77 is grounded at 105 to pump 51.

Power is furnished to the motor by conductor 107 from battery positive terminal 95, conductor 107 branching at 109 into conductors 111 and 113, connected respectively to motor terminals 115 and 117, motor terminal 119 being grounded via conductor 120 at 121, such that if conductor 111 is energized, motor 75 will rotate pump 51 in clockwise direction and if conductor 113 is energized the motor will rotate the pump in the counterclockwise direction, to cause corresponding movements of rotary hydraulic actuator 41 and of output shaft 31.

The control circuit for motor 75 comprises a conductor 123 extending from positive terminal 95 of battery 97, and containing a fuse switch 125, from which conductor 123 extends to terminal 127 of toggle switch 129 mounted in control panel 93. The opposite contacts 131 and 133 of toggle switch 129 are connected at their respective terminals 133 and 135 to the separate open and close control circuits and form parts of the same.

For illustrative purposes only, clockwise and counterclockwise movements of the operator parts will be treated herein as productive respectively of opening and closing movements of the line switch, but it will be understood that the operator can be connected to the switch to produce a reverse relationship.

The control circuit for producing clockwise movement comprises a conductor 137 including cam-operated limit switch 139 (which is closed when the line switch is closed) and the coil 141 of a relay, and is grounded through line 142 at 121. The contactor 143 of relay 141 is in conductor 111, such that when toggle switch 129 is in the clockwise position, i.e., engaging contact 131, and cam limit switch 139 is closed (indicating that the line switch is closed), coil 141 will be energized, closing its contactor 143 in conductor 111 and thereby energizing motor 75 to rotate pump 51 clockwise. For operating limit switch 139, a disc cam 145 is mounted on downward extension 30 of hydraulic actuator output shaft 29, cam 145 being constructed and arranged to close switch 139 as long as the shaft 29, 30 is in the switch-closed position and to permit switch 139 to open when the actuator shaft is in the switch fully-open position. Thus, when the line switch is fully open, cam 145 will permit switch 139 to open, thereby breaking the circuit through relay coil 141 to open contactor 143 and thus deenergize conductor 111 and stop rotation of motor 75 in the clockwise direction.

The circuit for producing counterclockwise movement comprises a conductor 139 including cam-operated limit switch 149 (which is closed when the line switch is opened) and the coil 151 of a relay and is grounded at 121. The contactor 153 of relay 151 is in conductor 113, such that when toggle switch 129 is in the close position, i.e., engaging contact 133, and cam limit switch 149 is closed (indicating that the line switch is open) relay coil 151 will be energized, closing its contactor 153 in conductor 113 and thereby energizing motor 75 to rotate pump 51 in the counterclockwise direction. For operating limit switch 149, a disc cam 155 is mounted on downward extension **29*a* of hydraulic actuator output shaft 29, cam 155 being constructed and arranged to close switch 149 as long as the shaft 29, 30 is in the line switch-open position and to permit switch 149 to open when the actuator shaft is in the line switch fully-closed position. Thus when the line switch is fully closed, cam 145 will permit switch 149 to open, breaking the circuit through relay coil 151 to open relay contactor 153 and thus deenergize conductor 113 and stop counterclockwise rotation of motor 75. For remote control operation of the mechanism, a common terminal 157 is provided for connecting remote control equipment 158 to the contact circuit via conductor 159 between fuse switch 125 and toggle switch 129 and terminals 161 and 163 are provided respectively in control conductors 137 and 147 anterior to limit switches 139 and 149, for connection to remote control equipment 162 and 164** capable of transmitting an electrical impulse of short duration sufficient to activate the respective control circuits.

To provide a supply of current to the control circuit to complete the opening or closing cycles respectively, after the initial local or remote signal is received, holding circuits comprising conductors 165 and 167 lead from conductors 111 and 113, respectively, posterior to relay contactors 143 and 153 to control conductors 137 and 147 to which they are connected respectively at terminals 169 and 171. Both of the holding circuits include diodes 173 and 175 for preventing the passage of current from control circuit conductors 137 and 147 through lines 165 and 167 into power circuit conductors 111 and 113. In addition, holding circuit conductor 165 includes a contactor 177 controlled by relay coil 151 so that when the latter is energized to cause closing rotation of motor 75, relay contactor 177 will be held open but will close when relay coil 151 is deenergized. Thus, during remote control, the initial electrical implulse received at terminal 161 via conductor 157 will, if limit switch 139 is closed (as it would be if the line switch were closed), reenergize relay coil 141 to close contactor 143 in counterclockwise power conductor 111 to motor 75, and current would flow from conductor 111 through holding circuit conductor 165 to line 137 to keep relay 141 energized until the line switch was fully opened and cam 145 permitted limit switch 139 to open, breaking the circuit through relay coil 141, which would, of course, cause relay contactor 143 to open, shutting off power to motor 75 through conductor 111 and thereby terminating hydraulic pressure on the counterclockwise side of the hydraulic actuator, to stop rotation of the switch operating shaft 31.

Holding circuit conductor 167 between motor power line 113 and switch closing control line 147 includes a contactor 179 controlled by relay coil 141 so that when the latter is energized to cause counterclockwise rotation of motor 75, relay contactor 179 will be held open so as to prevent the passage of current through conductor 167 during counterclockwise rotation of motor 75, but will close when relay coil 141 is deenergized. Thus during remote control, the initial electrical impulse received at terminal 163 via conductor 159 will, if closing limit switch 149 is closed (as it would be if the line switch were open) energize relay coil 151 to close contactor 153 in clockwise power circuit conductor 113 to motor 75, and current would flow from conductor 113 through conductor 167 to conductor 147 to continue energizing closing relay 151 until the line switch was fully closed, and cam 155 permitted closing limit switch 149 to open, breaking the circuit through the relay coil 151, which would, of course, cause relay contactor 153 to open, shutting off power to motor 75 through conductor 113 and thereby terminating hydraulic pressure on the clockwise side of the hydraulic actuator to stop rotation of the switch operating shaft 31.

In order to break hold circuits 165 and 167 in the event the line switch is frozen or otherwise inoperable, lines 181 and 183 connect hold circuit lines 165 and 167, posterior to relays 177 and 179 respectively, to time delay relay coil 183, which is grounded at 187, diodes 189 and 191 being located in lines 181 and 183 respectively to prevent reverse flow of current through either of the latter. Time delay relay 185 is constructed to open its normally closed contactor 193 in ground line 142 for control circuits 137 and 139, so as to break these circuits and deenergize the respective relay coils 141 and 151 and thereby open the respective relay switches 143 and 153 in the motor directional circuits 111 and 113.

For the information and guidance of persons manually operating or inspecting the equipment, a pair of contrastingly colored line switch position lights are mounted in contact panel 93 and may include green signal light 195 to show, by its illumination, that the line switch is open and a red signal light 197 to show that the line switch is closed. For energizing these lights, a conductor 199 leads from conductor 123 anterior to switch 127 to a double pole limit switch 201 controlled by disc cam 203 on hydraulic actuator shaft **29*a* such that when the line switch is open, limit switch 201 will engage contact 205, connected by conductor 207 to green light 195, which is grounded at 121 through conductor 209 thereby illuminating green light 195, and when the line switch is closed, switch 201 will engage contact 211, connected by conductor 213 to red light 197 which is similarly grounded at 121 through conductor 209, thereby illuminating red light 197**.

To prevent useless energization of lights 195 and 197 when the cabinet door is closed, and thereby save energy and increase the life of the lights, conductor 199 includes a normally open door-controlled switch 215 which breaks the signal light circuit while the door is shut and is closed by opening movement of the door to energize the light circuit.

For assuring satisfactory operation of the switch operator under cold weather conditions, an electric heater 226 is connected by conductors 228 and 229 respectively to imput conductors 83 and 85 and a thermostatically controlled switch 230 is in conductor 228, being arranged for closure when ambient temperatures fall below a predetermined value, so as to energize heater 227 and thereby maintain the interior of the cabinet and particularly the hydraulic apparatus therein at an operable temperature.

If desired, operation counters 217 and 219 can be connected by conductors 221 and 223 respectively to control circuit conductors 137 and 139, and grounded at 225 and 227, respectively, for counting the number of opening and closing operations performed by the operator.

Figure 9:
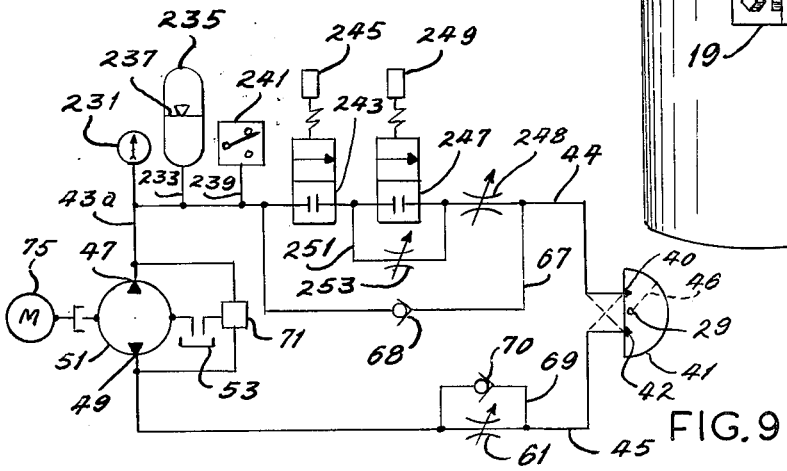
FIG. 9 is a hydraulic schematic of the modified switch operator illustrated in FIGS. 7 and 8.
Figure 7:
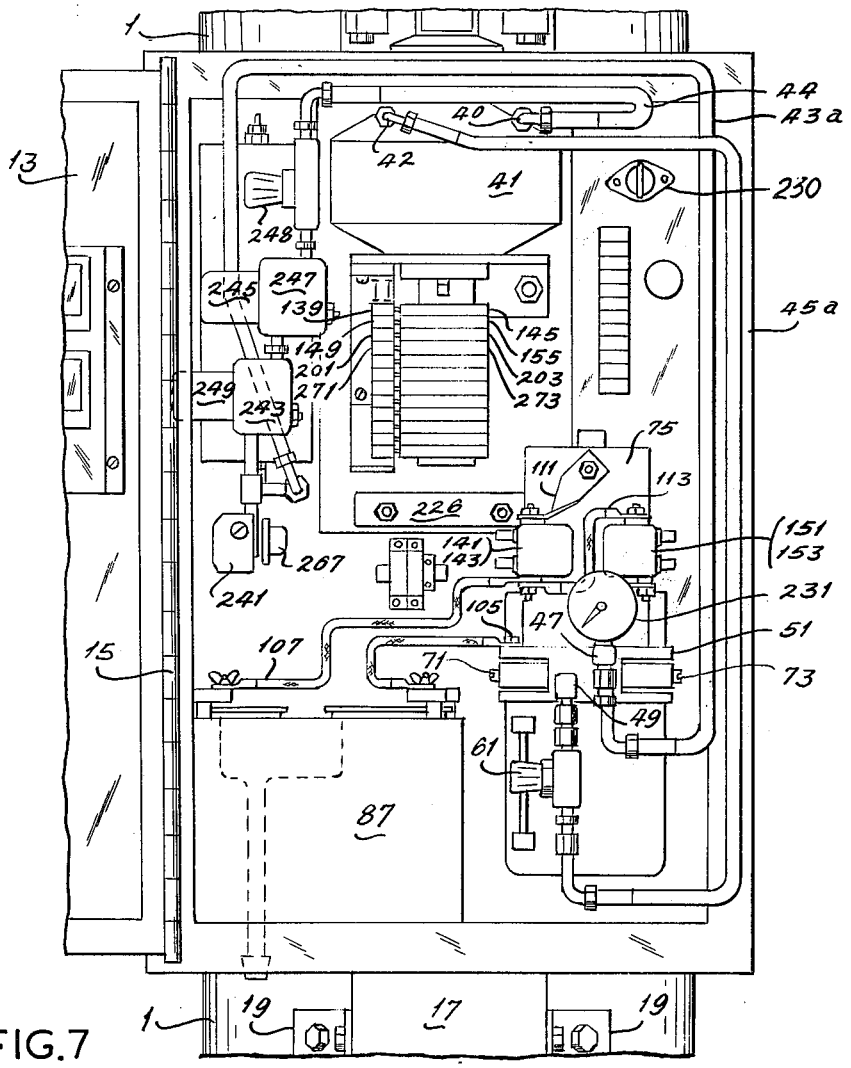
FIG. 7 is a front elevational view of the cabinet interior of a switch operator embodying a modified form of the invention.
Figure 8:
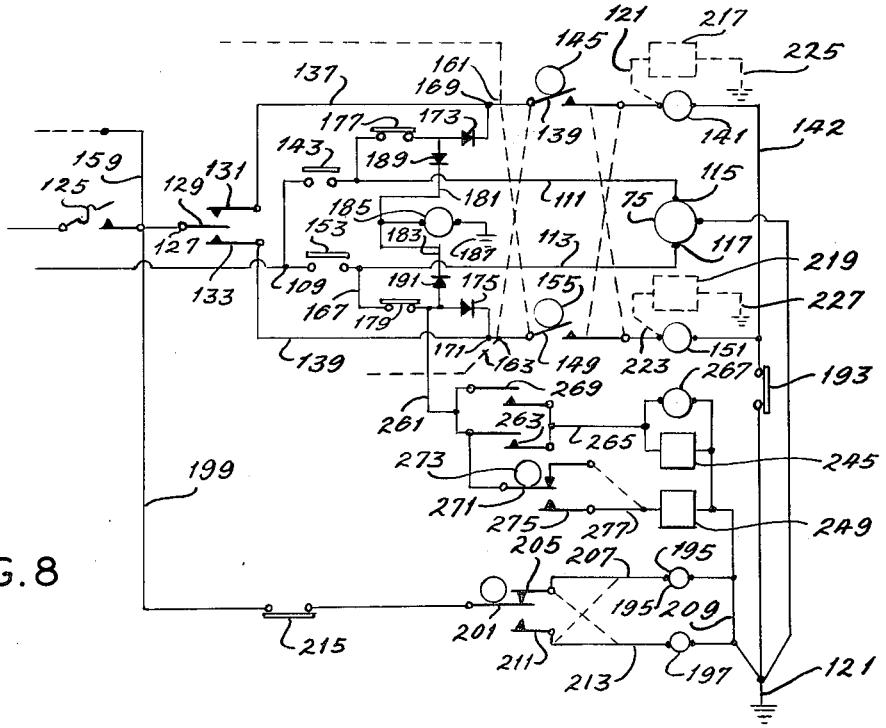
FIG. 8 is a partial electrical schematic of the modified switch operator shown in FIG. 7.

In the modified form of the invention illustrated in FIGS. 7–9, means is provided to effect fast closing of the line switch for the purpose of preventing arcing during the final portion of closing movement.

Operation of the embodiment shown in FIGS. 1–6 (as will best be understood from FIGS. 5 and 6) is as follows: With the line switch in the open position and with hydraulic actuator 41 operatively connected to it through output 29, coupling 33 and shaft 31, and with fuse switches 84 and 94 closed, battery charger 87 will maintain battery 97 fully charged. With fuse switch 125 in its normal closed position, after opening the cabinet door, the line switch can be operated locally. For local operation of the switch, door 13 must be opened and when this occurs door responsive switch 215 closes causing the flow of current from battery 97 through conductors 123 and 199 to limit switch 201. Since the line switch is open, limit switch 201 will be positioned as shown in FIG. 5 by cam 203 on shaft 30, in engagement with contact 205, whereby current flows through conductor 207 to green light 195 indicating by its illumination that its line switch is open. As the hydraulic actuator rotates between open and closed positions, cam 203 will similarly rotate causing limit switch 201 to alternatively energize green light 195 and red light 197 indicating respectively opened and closed conditions of the line switch. For local operation, toggle switch 129 is thrown to the switch-closing position, i.e., into conductive engagement with contact 133. Since disc cam 155 on actuator shaft extension 30 will have closed limit switch 149 in conductor 139, current through conductor 139 will energize relay coil 151 causing closure of relay contactor 153 and energizing motor closing circuit conductor 113 to cause rotation of motor 75 in switch closing direction. At the same time, normally closed relay contactor 179 in holding circuit conductor 167 will be closed because of the non-energization of relay coil 141 in conductor 137 and current will flow from conductor 113 through conductor 167 to and through conductor 139 to maintain relay coil 151 energized and its contactor 153 closed until the line switch closes fully, at which time cam 155 permits limit switch 149 to open, breaking the circuit through relay coil 151 and causing the latter to open relay contactor 153, thus breaking the circuit through motor 75. Referring now to FIG. 6, it will be seen that rotation of motor 75 caused corresponding rotation of pump 51 and movement of hydraulic fluid under pressure from pump port 47 to port 40 of hydraulic actuator 41 causing movement of the latter in the proper direction to close the line switch. Fluid on the opposite side of the actuator vane returns to pump 51 via actuator port 42, conduit 45, by-pass conduit 69 and port 49. Corresponding rotation of switch operating shaft 29 and hydraulic actuator extension 30 caused rotation of cam 155 to the line switch closed position, in which limit switch 149 opened, breaking the control motor circuits as described above. Corresponding rotation of opening limit switch cam 145 caused opening limit switch 139 to close when the line switch became fully open, thus preparing the electrical circuitry illustrated in FIG. 5 for an opening cycle of operation.

It will be noted from the foregoing that all energy for the entire operation is furnished by battery 97, both for directional control and powering motor 75.

To open the line switch by local control, toggle switch 129 is thrown to the open position conductively engaging its contact 131 and thereby energizing conductor 137. Since, as pointed out above, limit switch 139 is closed when the line switch is closed, relay coil 141 will be energized, closing its contactor 143 in power conductor 111 which energizes motor 75 in the proper direction to cause rotation of pump 51 in the direction necessary to pump hydraulic fluid through line 45 and into rotary actuator 41 through port 42, driving actuator output shaft 29 and line switch operating shaft 31 in the switch opening direction. Fluid on the other side of the actuator vane returns to pump 51 via conduit 43, by-pass conduit 67 and pump port 47. At the same time, normally closed contactor 177 of relay 151 is closed because of the non-energization of the relay 151 and current from conductor 111 passes through holding circuit conductor 165 into conductor 137 and maintains relay coil 141 energized as long as limit switch 139 remains closed. However, as soon as the line switch reaches fully open position, cam 145 permits limit switch 139 to open, breaking the circuit through relay coil 141 which opens to contactor 143 in power conductor 111, thus shutting off motor 75 and stopping pump 51. The electrical and hydraulic circuits are thus ready for another closing cycle.

If it is desired to operate the switch from a remote point, the switch can be closed by energizing terminal 163 in conductor 139 from the remote point. With limit switch 149 closed, relay coil 151 will thus be energized, closing contactor 153 in motor power conductor 113 and energizing the motor in the closing direction to cause closing operation of the hydraulic circuitry as described above. The circuit through relay coil 151 is kept energized by holding circuit conductor 167 until the line switch reaches the fully closed position in which cam 155 is rotated to a corresponding position opening limit switch 149, and thereby breaking the closing circuit and shutting off the motor.

Opening the switch by remote control can be similarly accomplished by remotely energizing terminal 161 in conductor 37.

In the event the line switch is inoperable, e.g., due to freezing, and opening or closing movements do not start within a predetermined time, preferably about 15 seconds, after the respective control circuits have been energized, time delay relay coil 185, energized through conductors 181 and 183 from holding circuits 165 and 167 will open contactor 193 in ground conductor 142 through which relay coils 141 and 151 are grounded and thus break the circuits through the opened and closing relay coils to shut the entire apparatus off and thus prevent damage to the electrical circuitry, hydraulic apparatus, and mechanical connections between the hydraulic apparatus and the line switch.

In FIGS. 7–9, the same numerals are used for identical elements as are used in FIGS. 1–6, modified elements are denoted by the same numerals as in FIGS. 1–6 followed by the letter "a", and entirely different or new elements are denoted by different numerals.

As in the previously described embodiment, for driving operating shaft 29 in opposite directions between switch closed and switch open positions, in the modified embodiment, as best seen in FIG. 9, the opposite ports 40 and 42 of rotary hydraulic actuator 41 are connected respectively by hydraulic conduits **43*a* and 45*a* to the opposite ports 47 and 49 of a reversible hydraulic pump 51 supplied by hydraulic fluid reservoir 53. Hydraulic conduit 43*a* which is arranged to cause closing rotational movements of the rotary actuator 41 includes a pressure gauge 231, a branch conduit 233 communicating with a hydraulic accumulator 235, containing a piston 237 and a fixed quantity of an inert gas such as nitrogen acting on piston 237 to maintain the hydraulic fluid in accumulator 235** under predetermined pressure.

To assure sufficient pressure in conduit **43*a* to effect the desired fast closure of the line switch, a second branch 239 leads from conduit 43*a* to a pressure-responsive switch 241, such that in the event pressure in conduit 43*a* declines below a predetermined value, e.g. 1200 psi, pressure responsive switch 241** will close.

From pressure switch 241, conduit **43*a* leads to normally closed start valve 243 operated by a solenoid 245, which is energized by pressure switch 241 to open valve 243 when pressure pump 51 builds up pressure in accumulator 235 to the predetermined value, at which time pressure switch 241 will close and cause start valve 243 to open. From start valve 243, conduit 43*a* leads to normally closed close-fast valve 247 controlled by a solenoid 249. A conduit 251 intersects conduit 43*a* anterior and posterior to valve 247, thereby by-passing the latter and includes a normally restricted variable orifice 253 through which liquid passes enroute from pump outlet 47 to the closing side of rotary actuator 41 so long as close-fast valve 247 remains closed, but when solenoid 249 is energized to open close-fast valve 257 liquid passes therethrough and via manually variable orifice 248 and conduit 44 into rotary actuator 41 at a sufficiently high speed to cause the desired fast closure movement of rotary actuator 41. Orifice 248 is arranged to permit manually varying the rate of flow between close-fast valve 247 and rotary actuator 41** and thereby selectively varying the speed of fast closure of the line switch.

Conduit **45*a* includes a manually variable restricted orifice 61 for selectively varying the return of flow of fluid through conduit 45*a* from the pump to the opening side of rotary actuator 41. The electrical circuitry by which the hydraulic circuitry of FIG. 9 is controlled is best seen in FIG. 8**.

To make it possible to use the same side of the hydraulic actuator for closure of the line switch irrespective of whether the line switch closing direction is clockwise or counterclockwise, conduit 44 may be connected to actuator port 42 and conduit 45*a* may be connected to actuator port 40, as shown in crossed broken lines in FIG. 9.

The electric circuitry of the modified embodiment of the invention is largely identical to that of the first embodiment shown in FIG. 5 and significant parts of it are illustrated schematically in FIG. 8. In addition to the electric control circuitry of the first embodiment as illustrated in FIG. 5, circuitry is provided to control operation of the fast closure hydraulic circuitry of FIG. 9, and includes a conductor 261 extending from a connection with holding circuit conductor 167, between contactor 179 and diode 175, to pressure switch 241. With start valve 243 in its normal closed condition, contact 263 of pressure switch 241 is open as long as pressure in conduit 43*a* is below the above-mentioned predetermined value and is connected by conductor 265 to start valve solenoid 245 and to start valve hold relay coil 267 which is in parallel with start valve solenoid 245 such that when pressure in accumulator 235 builds up to the predetermined value, pressure switch 241 closes, and current flows from conductor 167 through conductor 261, pressure switch 241 and conductor 265 to start valve solenoid 245, thereby opening start valve 243 and at the same time energizing start valve hold relay coil 265 to close start valve hold relay contactor 269, which is positioned between conductor 261 and conductor 265, such that even after pressure switch 241 has opened, start valve solenoid 245 will retain start valve 243 closed as long as the switch-closing holding circuit 167 is closed. Thus, when closing control conductor 139 is energized by manually throwing open-close toggle switch 127 into conductive engagement with its contact 133, and holding circuit 167 is accordingly energized as described previously in connection with the embodiment of FIGS. 1–6 above the predetermined value, pressure switch 241 will remain open until the predetermined pressure is reached in conduit 43*a*, and will then close energizing start valve solenoid 245 and opening start valve 243 to permit the passage of fluid therethrough, as long as the close circuit 139, 167, etc. is energized. A fourth limit switch 271 is connected to conductor 261 in parallel with pressure switch 241 and start valve hold switch 269 and is operated by a disc cam 273 on hydraulic actuator shaft extension 30, switch 271 being arranged for closure by cam 273 when the line switch, during closing movement, reaches a predetermined position, e.g. 45° prior to full closure. The limit switch 271 contact 275 is connected by conductor 277 to close-fast valve solenoid 249 so that when the closing control circuit 139 and its holding circuit 167 are energized and when pressure in the line is sufficient to cause pressure switch 241 to be closed and thus cause start valve 245 to open, hydraulic fluid will flow via conduit 43*a* through start valve 243, close-fast valve 247 and conduit 44 into rotary actuator 41 through port 40 (or if the connections are reversed, through port 42) to cause high speed rotation of the rotary actuator output shaft 29 during the final 45° of its line switch closing movement, to cause a correspondingly fast, non-arcing closure of the operated line switch. When the line switch reaches its fully closed position, acutator shaft extension 30 rotates disc cam 155 to a position at which limit switch 149 opens. This deenergizes relay coil 151 and opening relay contactor 153 to deenergize motor power circuit 113 and holding circuit 167, and conductor 261, causing start valve hold relay coil 267 to be deenergized and permitting its switch 269 to open, thereby deenergizing starting valve solenoid 245 and causing closure of the start valve 243. Similarly even though limit switch 271 controlling close-fast valve solenoid 249 is closed, close-fast valve solenoid 249 will be correspondingly deenergized and the close-fast valve will return to closed position. The apparatus will then be in condition for an opening cycle.

Operation of the embodiment of the invention shown in FIGS. 7–9 is similar to the operation of the first embodiment except for the provision of the fast closure electrical and hydraulic circuitry best seen in FIGS. 8 and 9. Thus the opening operation of the circuitry is identical to that of the first embodiment when the closing operation is initiated by moving toggle switch 129 into conductive engagement with closing contact 133, or when remote closing terminal 163 is energized remotely to energize closing relay coil 151 and thereby close its contact 153 to energize motor power conductor 113 and start motor 75 in the closing direction to cause corresponding rotation of hydraulic pump 51. When this occurs, normally closed starting valve 243 is closed and remains closed until pressure in hydraulic conduit 43*a* and accumulator 235 reaches a predetermined value, in the order of 1200 psi, at which point pressure responsive switch 241 closes, causing current to flow through conductor 261 from holding circuit conductor 167, thence through conductor 265 to starting valve solenoid 245 and to starting valve hold relay coil 267. Starting valve solenoid 245 thereupon opens starting valve 243 and starting valve hold relay coil 267 closes its contact 269 to maintain the starting valve open, even after pressure switch 241 opens. Hydraulic fluid then is free to pass through starting valve 243 and initially follows slow-close by-pass conduit 251 around normally closed close-fast valve 247. For controlling the slow-close speed of the fluid the slow-close speed orifice 253 can be manually adjusted. Fluid passes from slow-close by-pass conduit 251 through fast-close speed adjustment orifice 248 and conduit 44 into rotary actuator 41 via port 40 initiating closing movement of the line switch, which is imparted thereto by rotation of rotary actuator output shaft 29, coupling 33 and switch operating shaft 31. Fluid on the opposite side of the actuator vane returns to pump 51 via port 42, conduit 45, by-pass conduit 69, check valve 70 and pump port 49. When the line switch and its operating shaft 31 and accordingly hydraulic actuator output shaft 29 and its output shaft extension 30 reach a partially closed position, e.g. 45° short of full closure, cam 273 on hydraulic actuator shaft extension 30 causes limit switch 271 to engage contact 275, thereby energizing close-fast valve solenoid 249 and open close-fast valve 247 to permit fluid to flow unrestrictedly through the close-fast valve and thence through fast-close speed adjustment orifice 248 and conduit 44 into hydraulic actuator 41, causing high-speed movement of the latter during the final portion of the closing cycle. When the closing cycle is completed, cam 273 permits limit switch 271 to open, breaking the circuit through the close-fast valve solenoid 249 and making the closing circuit ready for the next closing cycle.

The details of the apparatus disclosed herein may be modified substantially without departing from the spirit of the invention and the exclusive use of such modifications as come within the scope of the appended claims is contemplated.

I claim:

1. A self-contained power operator powered from an external alternating current electrical power source for opening and closing an electric power line switch, comprising a reversible hydraulic rotary actuator, means for mechanically connecting said actuator to the line switch to produce rotary directional movements of the line switch corresponding to rotary directional movements of the actuator, a reversible hydraulic pump having separate outlet ports, separate means hydraulically connecting said outlet ports to opposite sides of said actuator, each of said hydraulic connecting means comprising a single conduit connected at its opposite ends to one of said pump outlet ports and to the corresponding side of said actuator, a reversible direct current electric motor drivingly coupled to said pump for driving the same selectively in opposite directions to produce respectively switch opening and closing directional rotary movements of said actuator, permanent means for electrical connection to an external alternating current electrical power source, an electric storage battery, a battery charger including a rectifier fed by said external alternating current power source connection means and permanently connected to said storage battery to maintain the same in charged condition, separate normally open power circuits connecting said storage battery to opposite poles of said motor for respectively energizing said motor for rotation in opposite directions, separate control circuits for selectively closing said power circuits to cause said motor to rotate in opposite directions, means for selectively energizing the respective control circuit, each said control circuit consisting solely of a limit switch and a relay coil in series, the limit switch in one of said control circuits being closed responsive to full closure of the line switch and opened when the line switch is open, the limit switch in the other of said control circuits being opened responsive to fully closure of the line switch and closed when the line switch is open, each said power circuit having a normally open switch consisting of a contactor of the relay coil in the corresponding control circuit closeable by energization of the latter whereby to energize the motor in the selected direction, a holding circuit connecting each said power circuit to the corresponding control circuit to maintain the latter energized throughout the full respective opening or closing movement of the line switch, said holding circuit including a normally closed switch consisting of a contactor of the relay coil in the opposite control circuit and openable when the opposite control circuit is energized to open said holding circuit switch and prevent energization of the corresponding control circuit and initiation of movements of the line switch in either direction during energization of the opposite control circuit and movements of the line switch in the other direction, each control circuit having a terminal intermediate the connection to the control circuit of the corresponding hold circuit and the limit switch in the control circuit for conductive attachment of remote control equipment, whereby to permit initial energization of the respective control circuits from remote locations, both said control circuits having a ground line with a normally closed switch therein, a time delay relay coil energizable by said control circuits and having a contactor forming the normally closed switch in said ground line, said time delay relay coil being constructed and arranged to open its contactor a predetermined short interval after its energization from either of said hold circuits, whereby to open said control circuits if the respective opening or closing operation of the line switch is not completed at the expiration of such time interval and thereby prevent damage to the operator if the line switch is inoperable for any reason.

2. A self-contained power operator according to claim 1, wherein each said hydraulic conduit includes a variably restricted orifice, and manual means for selectively varying the area of each said orifice whereby to adjust correspondingly the speed of opening and closure of the line switch.

3. A self-contained power operator according to claim 2, including a return by-pass conduit communicating with each said hydraulic conduit on both sides of said orifice, and a check valve in said by-pass conduit permitting flow of fluid therethrough only from said actuator toward said pump and preventing flow therethrough from said pump to said actuator whereby all fluid moving from said pump to said actuator must pass through said orifice.

4. A self-contained power operator according to claim 1 including a conductive connection between said separate control circuits and said battery, said conductive connection including a normally open manually actuable switch selectively closable to form a connection to either or said control circuits to permit initial local energization of the same.

5. A self-contained power operator according to claim 1, wherein the hydraulic conduit connecting one of the pump outlet ports to the closing side of said rotary actuator is connected to a hydraulic accumulator and includes between said accumulator and said rotary actuator a normally closed start valve, and means responsive to hydraulic pressure in said conduit for opening said normally closed start valve when pressure in said accumulator and said conduit exceeds a predetermined value.

6. A self-contained power operator according to claim 5, wherein said pressure responsive means comprises a normally open electric switch and a solenoid operatively connected to said normally closed start valve, and a conductor connecting said pressure responsive switch to the closing control circuit.

7. A self-contained power operator according to claim 5, wherein said hydraulic closing conduit includes a normally closed close-fast valve between said normally closed start valve and said actuator, means operatively connecting said close-fast valve and said actuator for opening said close-fast valve as said actuator approaches the fully closed position of the line switch, whereby to permit substantially unrestricted passage of pressurized fluid through said hydraulic closing conduit to the closing side of said rotary actuator during the final portion of the closing movement thereof and thereby effect a fast non-arcing closure of the line switch.

8. A self-contained power operator according to claim 7 including by-pass conduit means connected to said hydraulic closing conduit between said start valve and said close-fast valve and posterior to said close-fast valve, said by-pass conduit means including a manually adjustable restricted orifice for varying the slow closure speed of fluid flow to said actuator and the slow closure speed of said actuator.

9. A self-contained power operator according to claim 8 including a manually adjustable restricted orifice in said hydraulic closing conduit posterior to the last-named connection thereto of said by-pass conduit means for varying the fast final closing speed of the actuator and of the line switch.

10. A self-contained power operator according to claim 9, wherein said closing hydraulic conduit has a return by-pass conduit including a one-way check valve permitting passage of fluid through said return by-pass conduit only from said actuator to said pump, the opposite ends of said by-pass conduit being connected to said closing hydraulic conduit respectively anterior to said start valve and posterior to said fast-close speed adjustment orifice therein.

11. A self-contained power operator according to claim 7 including a solenoid operatively connected to said close-fast valve to open the same when said solenoid is energized and a normally open limit switch in parallel relation with said pressure-responsive switch connecting said last-named conductor to said close-fast valve solenoid, and means responsive to rotation of said actuator to a line switch partly closed position for closing said last-named limit switch and thereby energizing said close-fast valve solenoid to open said close-fast valve and permit the passage therethrough of pressurized fluid at high velocity to the closing side of said actuator, whereby to complete the closing movement of said actuator and the line switch at high speed.

12. A self-contained power operator according to claim 11 including a start valve hold relay coil connected in parallel with said start valve solenoid to said pressure switch, and a start valve solenoid relay contactor in parallel with said pressure-responsive switch for providing connection between said last-named conductor and said start valve solenoid after said pressure-responsive switch has opened and until said closing control circuit is deenergized, whereby to maintain said start valve solenoid energized and said start valve open after said pressure-responsive switch has opened and until said closing control circuit is broken.

* * * * *